US007409949B1

(12) United States Patent
Zauner et al.

(10) Patent No.: US 7,409,949 B1
(45) Date of Patent: Aug. 12, 2008

(54) IGNITION HOUSING FOR INTERNAL COMBUSTION ENGINE

(75) Inventors: Günther Zauner, Peuerbach (AT); Ernst Mayringer, Ruestorf (AT); Johann Wickenhauser, Offenhausen (AT); Mario Schreiber, Grieskirchen (AT); Thomas Weinzierl, Fraham (AT); Wolfgang Schrenk, Gallneukirchen (AT)

(73) Assignee: BRP-Rotax GmbH & Co. KG, Gunskirchen (AT)

( * ) Notice: Subject to any disclaimer, the term of this patent is extended or adjusted under 35 U.S.C. 154(b) by 0 days.

(21) Appl. No.: 11/626,310

(22) Filed: Jan. 23, 2007

Related U.S. Application Data

(60) Provisional application No. 60/885,976, filed on Jan. 22, 2007.

(51) Int. Cl.
*F02P 7/08* (2006.01)

(52) U.S. Cl. ..... 123/647; 123/143 C; 123/185.3; 180/190

(58) Field of Classification Search ..... 123/143 C, 123/185.2, 185.3, 647; 180/190
See application file for complete search history.

(56) References Cited

U.S. PATENT DOCUMENTS 4,155,340 A * 5/1979 Fernquist et al. ..... 123/647
5,353,758 A * 10/1994 Masuda et al. ..... 123/143 C

* cited by examiner

*Primary Examiner*—T. M Argenbright
(74) *Attorney, Agent, or Firm*—Osler, Hoskin & Harcourt LLP

(57) ABSTRACT

A two-stroke internal combustion engine including a molded ignition housing connected to the crankcase of the engine which protects the electric generator of two-stroke internal combustion engine.

23 Claims, 4 Drawing Sheets

IGNITION HOUSING FOR INTERNAL COMBUSTION ENGINE

CROSS REFERENCES TO RELATED APPLICATIONS

The present Utility patent application claims priority from U.S. Provisional Patent Application No. 60/885,976 filed Jan. 22, 2007, the content of which is incorporated herein by reference.

FIELD OF THE INVENTION

The present invention relates generally to two-stroke internal combustion engines, and to ignition housing for two-stroke internal combustion engines in particular.

BACKGROUND OF THE INVENTION

Two-stroke internal combustion engines in recreational vehicles typically comprise a cast crankcase with an integral ignition housing. In modern internal combustion engines, aluminum is used for this purpose as aluminum provides the necessary strength and heat transfer properties. The ignition housing must be strong in order to protect the electric generator which it covers. However, cast aluminium alloy crankcase are heavy and they transmit vibrations as well as heat. The aluminium alloy ignition housing resonate and amplify the vibrations of the engine, making the two-stroke engine noisier.

An important requirement in recreational vehicle design is the overall weight of the vehicle. Since cast aluminium alloy ignition housing are heavy, some engine parts have been made of magnesium or magnesium alloy, which is a light-weight material, to reduce the weight of the engine. However, magnesium is an expensive metal and increases the overall cost of the engine.

Thus, there is a need for a two-stroke engine having an ignition housing cover that alleviates some of the drawbacks of prior two-stroke engines.

STATEMENT OF THE INVENTION

One aspect of the present invention is to provide an internal combustion engine operating on a two-stroke principal, the engine comprising: a crankcase, and a crankshaft rotatably supported within the crankcase; at least one cylinder and a cylinder head above the at least one cylinder, the at least one cylinder and the cylinder head together defining at least one combustion chamber; a piston disposed in the at least one cylinder so as to be capable of reciprocal movement and operatively connected to the crankshaft; a generator disposed outside the crankcase, the generator being operatively connected to one end of the crankshaft. The internal combustion engine includes a molded ignition housing distinct from the crankcase, the molded ignition housing including a generally cylindrical main body having a length, a first end and a second end, the main body having an opening such that the main body surrounds the generator, the first end connecting the main body to the crankcase; the molded ignition housing being made of a synthetic resin.

In another aspect, the molded ignition housing is made of a fiber reinforced organic thermoplastic. Preferably, the organic thermoplastic used is a polyamide based nylon. More preferably, the polyamide based nylon is polyamide 6.6.

In a further aspect, the main body of the molded ignition housing includes a recess extending inwardly from the second end along the length of the main body. The recess has a structural ridge extending on one side of the recess along the length of the main body. Preferably, there is a second a structural ridge extending on a second side of the recess, along the length of the main body.

In an additional aspect, the recess further comprises reinforcement ribs extending along the length of the main body.

In an additional aspect, the engine further comprises a recoil starter operatively connected to one end of the crankshaft adjacent the generator and an end plate connected to the second end of the ignition housing, the end plate covering the recoil starter.

Another aspect of the present invention is to provide a snowmobile comprising: a frame having a forward end and a rearward end; a drive track assembly disposed below and supporting the rearward end of the frame; a front suspension connected to the forward end of the frame; two skis connected to the front suspension; a two-stroke engine mounted on the frame and operatively connected to the drive track via a drive train for delivering propulsive power to the drive track; the two-stroke engine comprising: a crankcase, and a crankshaft supported within the crankcase for rotation; at least one cylinder and a cylinder head above the at least one cylinder, the at least one cylinder and the cylinder head together defining at least one combustion chamber; a piston disposed in the at least one cylinder and operatively connected to the crankshaft for reciprocal movement; a generator disposed outside the crankcase, the generator being operatively connected to one end of the crankshaft; and a molded ignition housing distinct from the crankcase, the molded ignition housing including a generally cylindrical main body having a length, a first end and a second end, the main body having an opening such that the main body surrounds the generator, the first end connecting the main body to the crankcase; the molded ignition housing being made of a synthetic resin.

For the purposes of this application, the term "cylindrical" is used to describe the general shape of the molded ignition housing and is not to be restricted to a circular shape. The term "cylindrical" includes square shape or angular shape elongated bodies having an opening or inner space within.

Embodiments of the present invention each have at least one of the above-mentioned aspects, but not necessarily have all of them.

Additional and/or alternative features, aspects and advantages of the embodiments of the present invention will become apparent from the following description, the accompanying drawings and the appended claims.

BRIEF DESCRIPTION OF THE DRAWINGS

For a better understanding of the present invention as well as other aspects and further features thereof, reference is made to the following description which is to be used in conjunction with the accompanying drawings, where.

DESCRIPTION OF PREFERRED EMBODIMENT(S)

Figure 1:
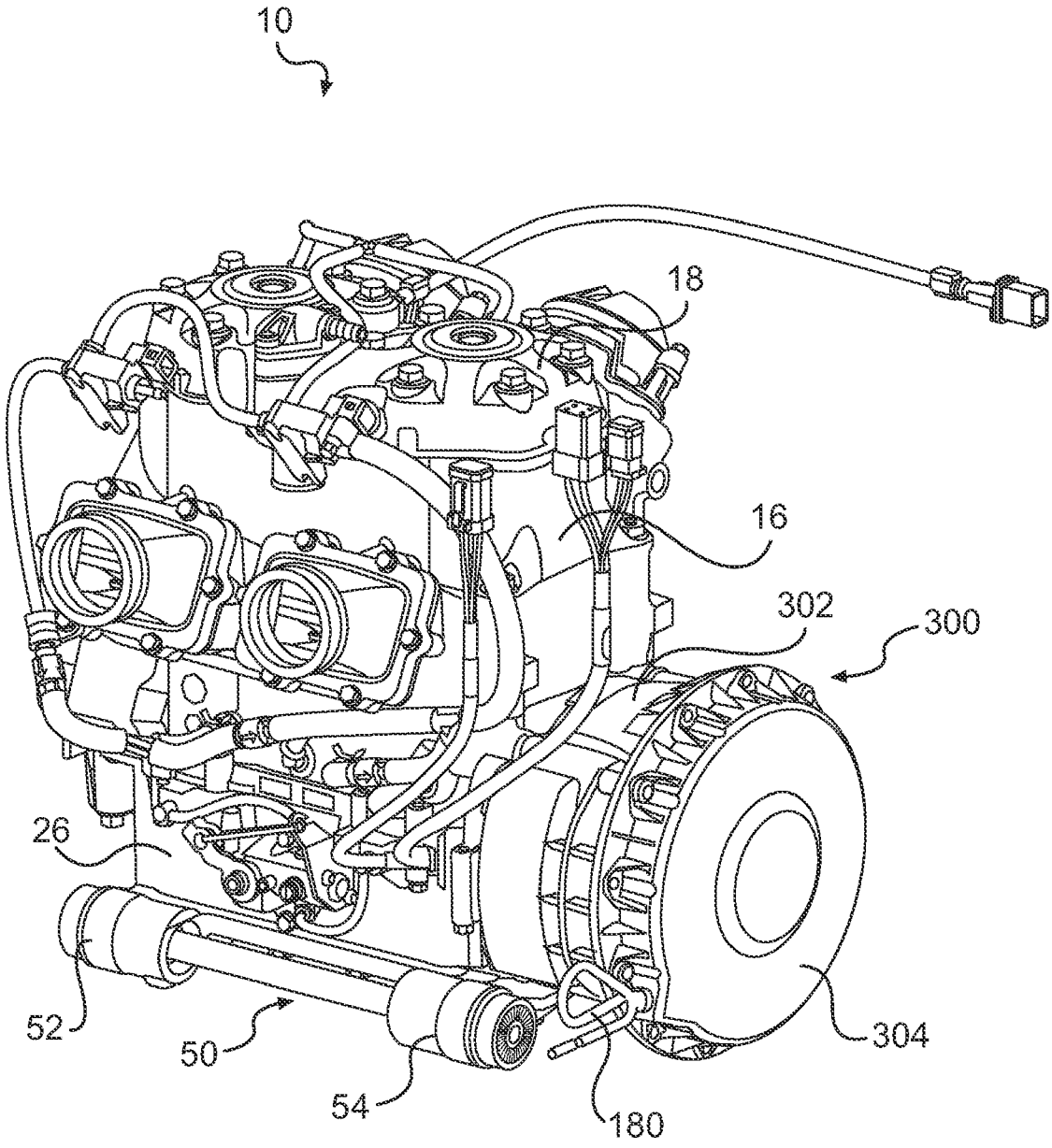
FIG. 1 is a perspective view of a two-stroke internal combustion engine in accordance with one embodiment of the invention.

With reference to FIG. 1, which is a perspective view of a two-stroke internal combustion engine 10, the two-stroke internal combustion engine 10 includes a crankcase 26, a cylinder block 16 disposed above the crankcase 26 and secured thereto, a cylinder head 18 disposed above the cylinder block 16 and secured thereto, and a base plate 50 connected to the bottom of the crankcase 26. The base plate 50 includes engine mounts 52 and 54 for securing the engine 10 to a frame of a recreational vehicle. A molded ignition housing cover 300, distinct and separate from the crankcase 26, is connected to one side of the crankcase 26 to isolate and protect an electric generator 174 (FIG. 2) of the engine 10. The molded housing cover 300 includes a main body 302 which is directly connected to the side of the crankcase 26 and surrounds the generator, and a separate end plate 304 connected to the end of the main body 302 which closes the housing. A handle 180 protrudes from the side of the end plate 304. The handle 180 is attached to a rope 179 which is wound around the recoil starter 178 (FIG. 2) for starting the engine 10 as is known in the art.

Figure 2:
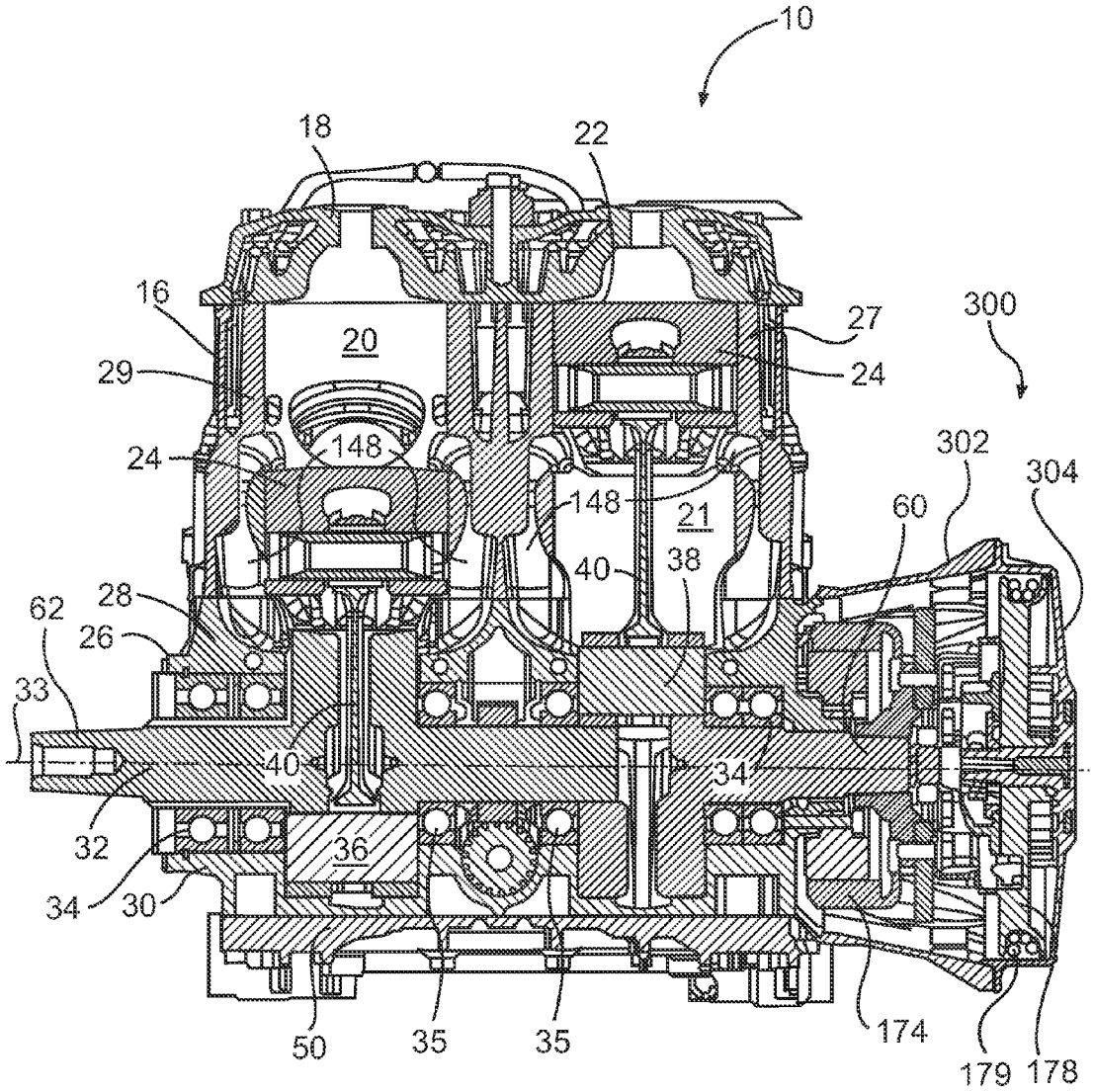
FIG. 2 is a cross sectional view of the of the two-stroke internal combustion engine shown in FIG. 1.

With reference to FIG. 2, which is a cut-away view of the two-stroke internal combustion engine 10 along its longitudinal axis, the cylinder block 16 includes two cylinders 27 and 29. The two cylinders 27 and 29 and the cylinder head 18 together define two combustion chambers 20 and 22 each housing a piston 24. The crankcase 26 is horizontally split into an upper half 28 and a lower half 30 that are secured together and support a crankshaft 32 via end bearings 34 and central bearings 35 held within bearing housings formed within the crankcase 26. The crankshaft 32 includes a first end 60, a second end 62 and a crankshaft axis 33 about which the crankshaft 32 rotates. The crankshaft axis 33 is substantially horizontally when the two-stroke engine 10 is installed in the frame of vehicle. The cylinder block 16 is assembled to the upper half 28 of the crankcase 26 via a series of bolts as is well known. The pistons 24 are connected to the connecting rod journals 36 and 38 of the crankshaft 32 via connecting rods 40 such that reciprocal movement of the pistons within the cylinders is transferred to the crankshaft 32 as rotational movement.

The cylinder block 16 includes transfer ports 148 which link crankcase chambers 21 under each piston 24 with the combustion chambers 20 and 22. As is known in the art, rotation of the crankshaft 32 correlates to each piston 24 reciprocating in its respective cylinder between a bottom dead center and a top dead center, acting as a pump and opening and closing the intake ports and the transfer ports 148 in the cylinders to effectuate the combustion process. Referring to FIGS. 1 and 2, as piston 24 moves up its cylinder, it creates a vacuum in its respective crankcase chamber 21. This vacuum causes an intake charge to enter that crankcase chamber 21 from the intake port. As the piston 24 moves down in the cylinder, it pressurizes the intake charge until the transfer ports 148 are uncovered by the piston 24, whereupon the intake charge is forced from the crankcase chamber 21 to the interior of the combustion chamber 20 through the transfer ports 148. As the piston 24 moves up again in the cylinder, it compresses the intake charge in the cylinder into the combustion chamber for combustion while simultaneously again causing an intake charge to be sucked into the crankcase chamber 21.

The two-stroke internal combustion engine 10 is a two cylinder engine having a volumetric displacement of 400 cc. In other embodiments, the two-stroke internal combustion engine 10 has a volumetric displacement of 400 cc or more. For instance, the two-stroke internal combustion engine 10 can have a volumetric displacement of 550 cc or more.

The electrical generator 174 is connected to the first end 60 of the crankshaft 32 which protrudes from the crankcase 26 and drives the electrical generator 174. The electrical generator 174 produces the electrical current necessary to generate the sparks of the spark plugs (not shown) to ignite the fuel-air mixture in the combustion chambers 20 and 22. The electric generator 174 is powerful to supply electrical current to the engine control system (injections, sensors, etc.) and sufficient energy to supply an inductive ignition system.

The electrical generator 174 is enclosed within the ignition housing cover 300. The ignition housing cover 300 includes a generally cylindrical main body 302 that extends along the crankshaft axis 33, and the end cover 304. The ignition housing cover 300 insulates at least partially the electric generator 174. The ignition housing cover 300 shields the electric generator 174 from the heat in the surrounding environment (exhaust pipes, etc.) and also shields the surrounding components from heat generated by the electric generator 174. The ignition housing cover 300 also protects the electric generator 174 from impact. The ignition housing cover 300 also provides a sound barrier to reduce the level of the noise made by the electric generator 174 or any other components of the engine that generate vibrations that can be amplified by the ignition housing 300.

The end plate 304 of the ignition housing cover 300 covers and protects the recoil starter 178 which is also connected to the first end 60 of the crankshaft 32 adjacent the electric generator 174. The end plate 304 is separate from the main body 302 of the ignition housing 300 and secured thereto. The generally cylindrical main body 302 of the ignition housing cover 300 widens from the crankcase 26 to the end plate 304 to accommodate the larger diameter of the recoil starter 178. The larger diameter of the recoil starter 178 is required to provide adequate leverage to manually crank the engine 10. The end plate 304 effectively acts as the cover for the recoil starter 178.

Figure 3:
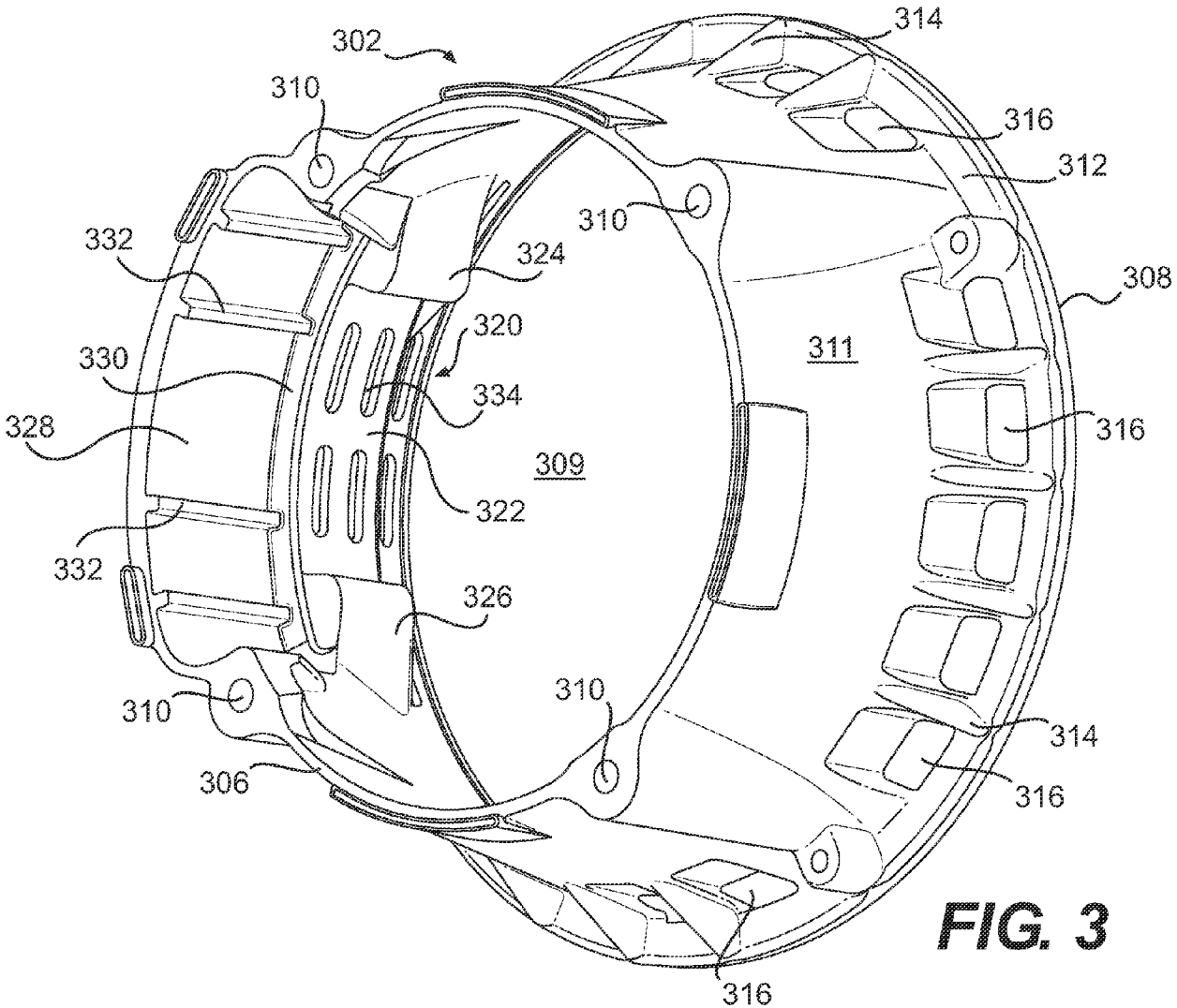
FIG. 3 is a perspective view of a molded component of the two-stroke internal combustion engine shown in FIG. 1.

With reference to FIG. 3, which is a side perspective view of the main body 302 of the ignition housing cover 300 removed from the engine 10, the main body 302 has a generally cylindrical shape and extends a length sufficient to surround the electric generator 174. The generally cylindrical shape of the main body 302 extends from a first end 306 to a second end 308 and defines an inner space 309 for housing the electric generator 174 and the ancillary components of the electric generator 174. The first end 306 includes a series of apertures 310 for securing the main body 302 to the crankcase 26 via bolts. The second end 308 includes a rim 312 which extends outwardly from the main body 302 and rigidifies the entire circumference of the second end 308. A series of stiffeners 314 positioned between the rim 312 and the wall 311 of the main body 302 further rigidify the structure of the main body 302. Cooling vents 316 are disposed in between the stiffeners 314 and spread around the circumference of the second end 308 of the main body 302. The cooling vents 316 enable heat generated by the electric generator 174 to escape the ignition housing cover 300 and fresh air to enter thereby cooling the electric generator 174 and the ignition housing cover 300 itself.

The main body 302 also includes a recess 320 which extend inwardly from the second end 308. The recess 320 provides the necessary additional space for inserting a tool used to remove the electric generator 174 from the first end 60 of the crankshaft 32. The tool is a pulling device comprising an arm which is inserted through the recess 320 behind the electric generator 174 and is used to pull the electric generator 174 from the crankshaft 32. To pull the electric generator 174 from the crankshaft 32, a large screw connected to the arm of the tool is positioned at the end of the crankshaft 32. When the screw is rotated, the arm pulls the electric generator 174 from the crankshaft 32. To prevent rotation of the tool when rotating the screw, the recess 320 is provided with structural ridges 324 and 326. The tool rests against the structural ridges 324 and 326 and is prevented from turning with the rotating screw. The structural ridges 324 and 326 are provided on each side of the recess 320 to increase the strength of the recess 320 in order to resist the leverage force of the tool. The recess 320 is therefore rigidified by the structural ridges 324 and 326 to withstand the force applied by the pulling tool. The structural ridges 324 and 326 extend parallel to the recess 320 and provide a large surface onto which the pulling tool can rest against. The rear end 328 of the recess 320 provides added rigidity to the wall 322. The rear end 328 is separated from the wall 322 by a crest 330 which is itself reinforced with a series of ribs 332. The whole rear end 328 is therefore rigidified by the crest 330 and the ribs 332 and further increase the strength of the wall 322 and the structural ridges 324 and 326. Two of the apertures 310 used to secure the main body 302 of the ignition housing cover 300 to the crankcase 26 via bolts are positioned on each side of the recess 320. When the main body 302 of the ignition housing cover 300 is mounted to the crankcase 26, the bolts provide rigid support to the rear end 328 of the recess 320 which in turn further increase the rigidity and strength of the structural ridges 324 and 326.

The ribs 332 of the rear end 328 are also used to position to sensors which relay the angle of rotation of the crankshaft 32, and therefore the position of the pistons 24 inside the cylinders 27 and 29, to the ignition system of the engine 10. The position sensors are preferably Hall sensors or inductive sensors.

The wall 322 of the recess portion 320 includes a series of cooling vents 334 to allow ingress of cool air into the ignition housing cover 300.

The main body 302 of the ignition housing cover 300 is a molded component made of a high strength synthetic resin reinforced with fiber glass to provide the necessary rigidity to the main body 302. The synthetic resin can be reinforced with other types of fibers such as carbon fiber. The synthetic resin can be reinforced with other shapes of reinforcement such as particles or beads. Preferably, main body 302 of the ignition housing cover 300 is made of an organic thermoplastic which is reinforced with fiber glass. In the illustrated embodiment, the organic thermoplastic used is a polyamide based nylon which provides the necessary rigidity to the main body 302. Polyamide is well suited to withstand high temperature and sudden increase in temperature as is found in the vicinity of the electric generator 174. Polyamide possesses the high mechanical strength necessary to resist the mechanical forces applied to the recess portion 320 of the main body 302 when the pulling tool is used to remove the electric generator 174 from the crankshaft 32 as previously described. Polyamide also exhibits excellent chemical resistance and high wear resistance.

The tensile strength of the reinforced synthetic resin ranges from 80 MPa to 140 MPa depending on the synthetic resin and the reinforcement used. The reinforced synthetic resin preferably has a tensile strength of at least 100 MPa and more preferably at least 120 MPa. The tensile strength of the material is preferably meets the requirements of the norms ISO 527.

The main body 302 as well as the end plate 304 are preferably made of a polyamide 6.6 with 20% of fiberglass. The polyamide 6.6 with 20% of fiberglass is able to resist the heat generated by the electric generator 174 positioned inside the ignition housing cover 300 without deformation, as well as able to resist heat generated by the surrounding engine components such as the exhaust system of the vehicle. The tensile strength of polyamide 6.6 reinforced with 20% of fiberglass is between 80 MPa and 140 MPa which is adequate to resist the pressure of the pulling tool.

The name polyamide 6.6 comes from the number of carbon atoms in the repeating units, 6 in this case.

The molded ignition housing cover 300 is lighter than conventional ignition housing cover made of cast aluminum or cast magnesium and therefore reduces the overall weight of the two-stroke engine 10.

Furthermore, the material of the molded ignition housing cover 300 provides sound absorption qualities to the ignition housing cover 300. Experimentally, the sound made by the engine 10 is reduced by approximately 1.5 dB when the engine 10 is equipped with a ignition housing cover 300 made of molded synthetic resin reinforced with fiberglass as compared to a typical ignition housing cover made of cast aluminum as in prior art two-stroke engines. In effect, the vibrations of the engine 10 and of the electric generator 174 are partially absorbed by the molded ignition housing cover 300. In the prior art, cast aluminum housing covers tended to resonate in harmony with the vibrations of the engine 10 and of the electric generator 174 and act as sounding boards whereas the molded ignition housing cover 300 tends to absorb the vibration and reduce the transfer of these vibrations to the surrounding environment.

The two-stroke internal combustion engine 10 which includes the molded ignition housing cover 300 can be mounted in recreational vehicles (such as All-Terrain Vehicle (ATV) and snowmobile) that benefit from the weight savings of the molded ignition housing cover 300 as well as the noise reduction properties of the molded ignition housing cover 300.

Figure 4:
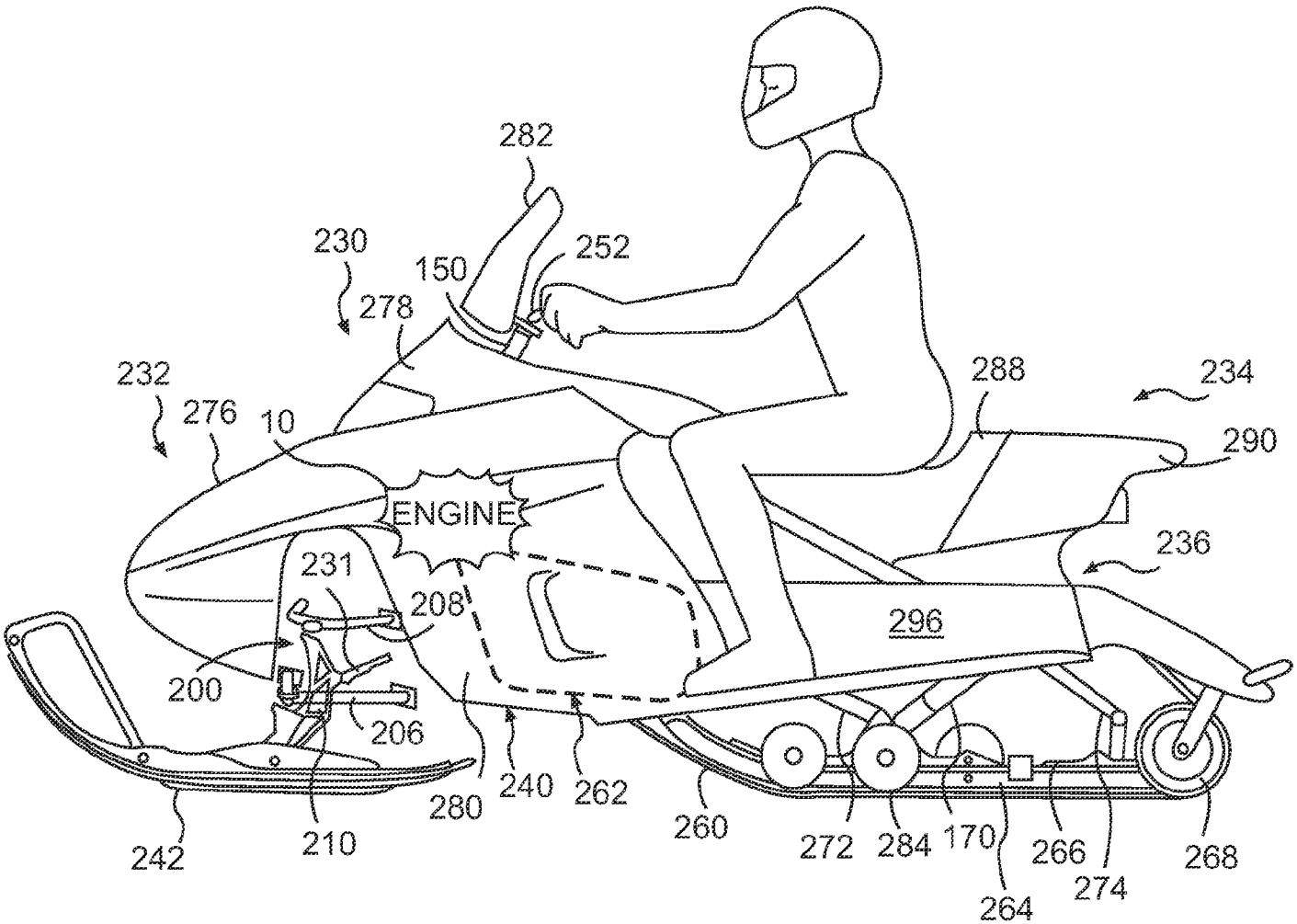
FIG. 4 is a side elevational view of a snowmobile including the two-stroke internal combustion engine shown in FIG. 1.
Figure 1:
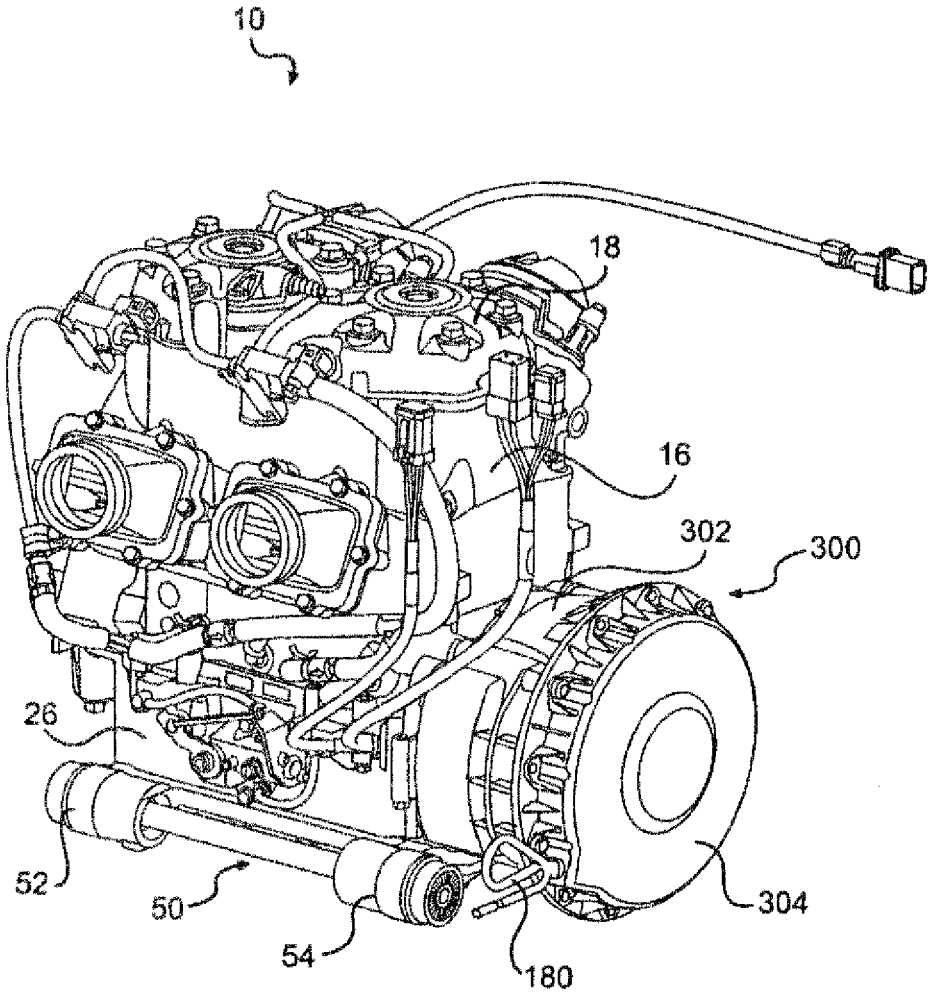
Figure 2:
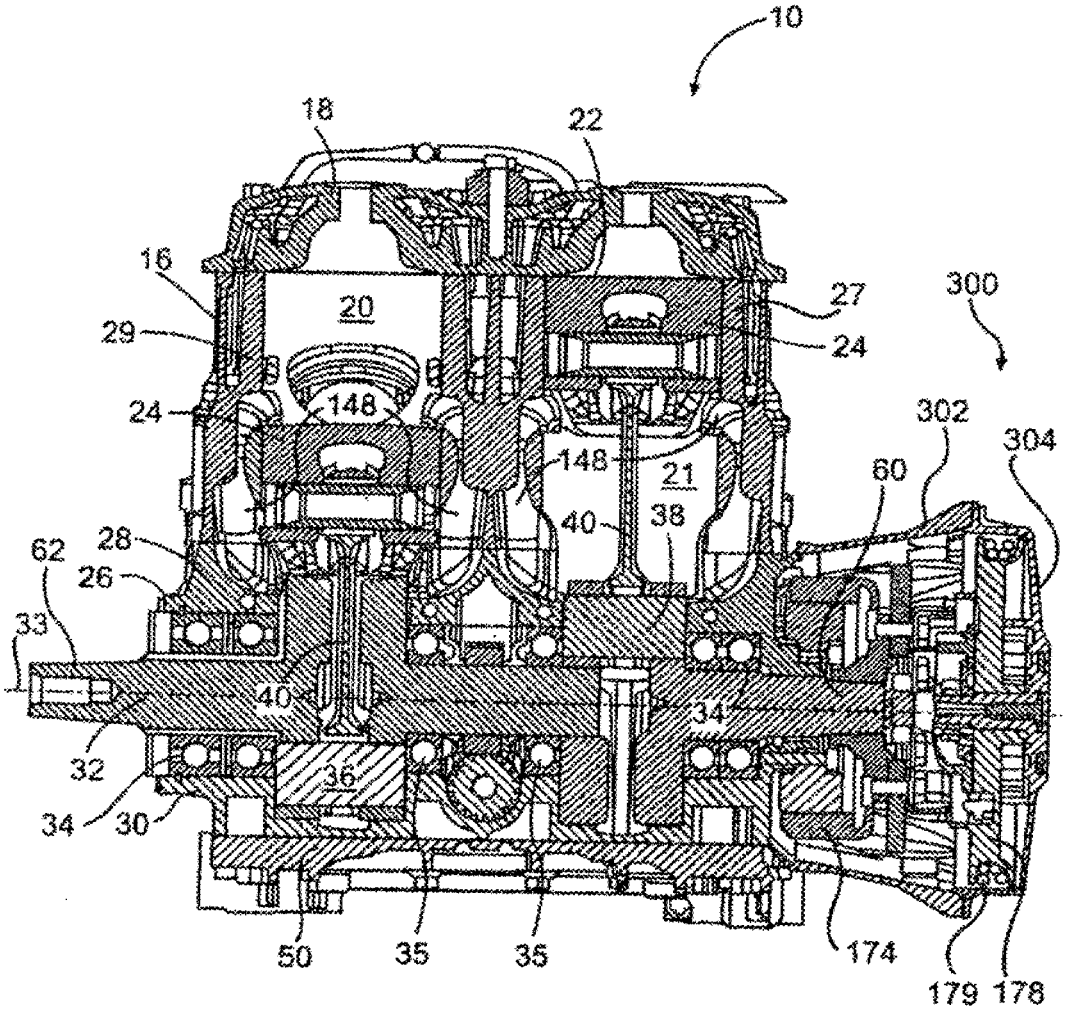
Figure 3:
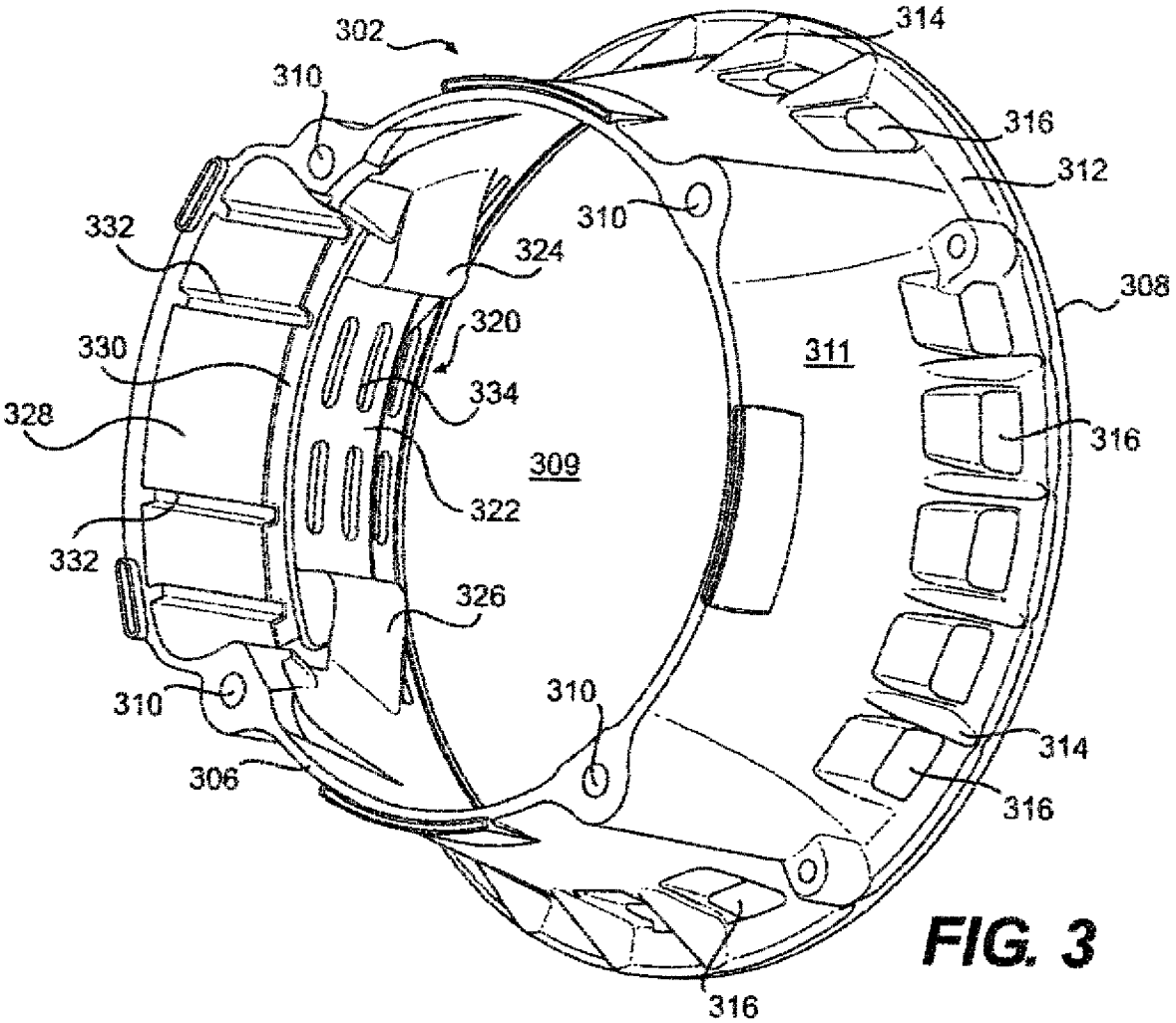
Figure 4:
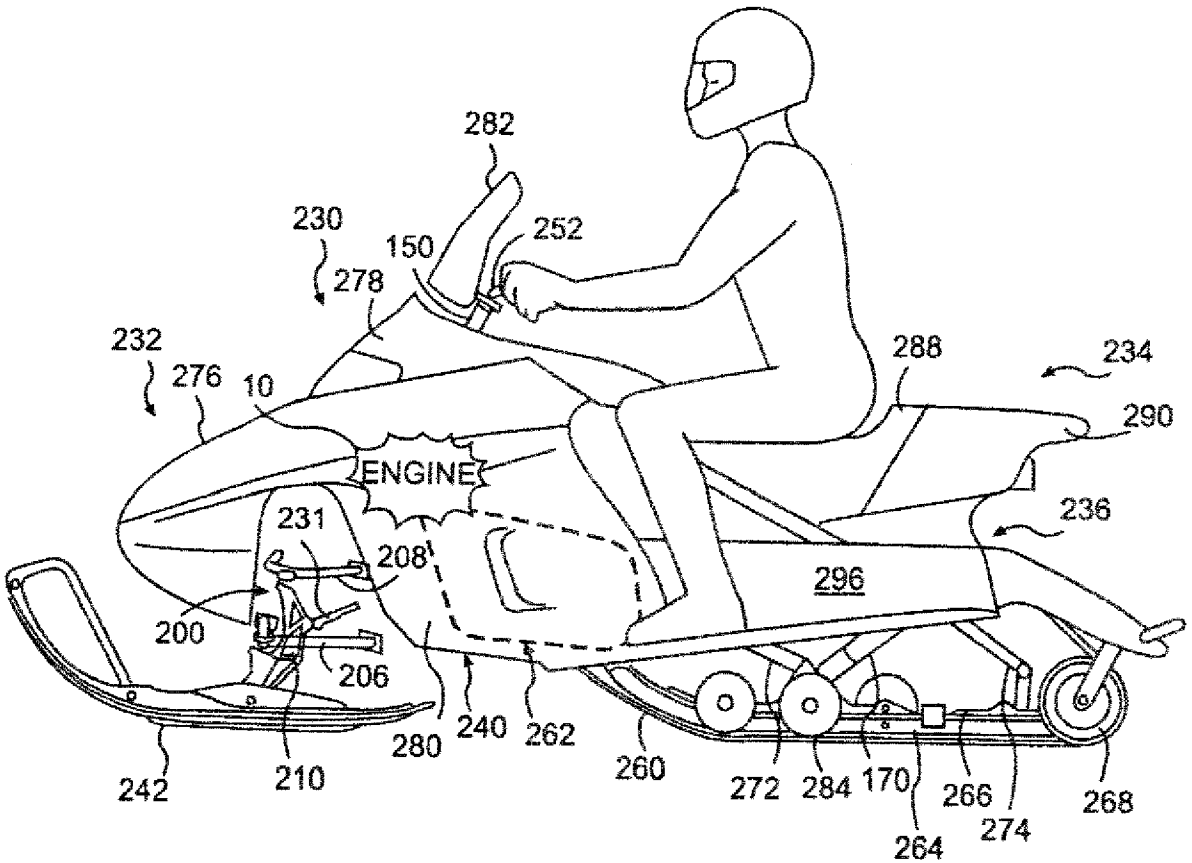

FIG. 4 illustrates a snowmobile 230 in accordance with one specific embodiment of the invention. The snowmobile 230 includes a forward end 232 and a rearward end 234 which are defined consistently with a travel direction of the vehicle. The snowmobile 230 includes a frame 236 comprising an engine cradle portion 240 and a tunnel 296. Tunnel 296 generally consists of an inverted U-shaped bent sheet metal connected to the engine cradle portion 240 which extends rearwardly along the longitudinal axis of the snowmobile 230. While hidden behind a front fairing 254, a two-stroke engine 10 in accordance with the present invention, schematically illustrated, is mounted to the engine cradle portion 240 of the frame 236 and provides motive force for the snowmobile 230.

Two front skis 242 are attached to the front portion of the frame 236 through a front suspension system 200. The front suspension system 200 generally comprises a double A-arm type suspension, having upper A-arms 208 and lower A-arms 206 on either side of the vehicle linking spindles 210 to the frame 236. The spindles 210 are attached to the skis 242 at their lower ends and rotate left and right therewith. The spindles 210 are also connected to a steering column 250 via steering rods 231. The steering column 250 is attached at its upper end to a steering device such as a handlebar 252 which is positioned forward of a rider and slightly behind the two-stroke engine 10 to rotate the skis 242, thereby providing directional control of the snowmobile 230. Thus, by turning the steering device 252, the spindles 210 are pivoted and the skis 242 are turned to steer the snowmobile 230 in a desired direction.

An endless drive track 260, which provides propulsion to the snowmobile 230, is disposed under the tunnel 296 of the frame 236 with the upper portion of the drive track 260 accommodated within the tunnel 296. The endless drive track 260 is operatively connected to the two-stroke engine 10 through a belt transmission system 262 which is schematically illustrated by broken lines. The drive train of the snowmobile 230 includes all the components of the snowmobile 230 whose function is to transmit power from the engine to the ground including the belt transmission system. The endless drive track 260 is mounted to the tunnel 296 via a rear suspension assembly 264. The rear suspension assembly 264 includes rear suspension arms 272 and 274, a pair of slide rails 266 which generally position and guide the endless drive track 260 and idler wheels 268 engaged therewith. Rear suspension arms 272 and 274 connect the slide rails 266 and idler wheels 268 to the tunnel 296 of the frame 236. The slide rails 266 typically include a sliding lower surface made of polyethylene to reduce contact friction between the slide rails 266 and the drive track 260. The rear suspension assembly 264 also includes one or more shock absorbers 270 which may further include a coil spring (not shown) surrounding the individual shock absorbers 270.

At the front end 232, the snowmobile 230 includes an external shell consisting of fairings 276 that enclose and protect the two-stroke engine 10 and transmission 262 and that can be decorated to render the snowmobile 230 more aesthetically pleasing. Typically, the fairings 276 include a hood 278 and one or more side panels 280 which can be opened to allow access to the two-stroke engine 10 and the transmission 262 when this is required, for example, for inspection or maintenance. The side panels 280 can be opened away from the snowmobile 230 along a vertical axis, independently from the hood 278, which pivots forward about a horizontally extending axis. A windshield 282, which may be connected either to the fairings 276 or directly to the handlebars 252, acts as wind deflector to lessen the force of the air on the rider when the snowmobile is moving.

A straddle-type seat 288 is positioned atop and mounted to the tunnel 296. At the rear of the straddle seat 288, a storage compartment 290 is provided. A passenger seat (not shown) can also be provided instead of the storage compartment 290. Two footrests 284, generally extending outwardly from the tunnel 296, are also positioned on either side of the straddle seat 288 to accommodate the rider's feet and provide a rigid platform for the rider to stand on when maneuvering the snowmobile 230.

Modifications and improvement to the above described embodiments of the present invention may become apparent to those skilled in the art. The foregoing description is intended to be exemplary rather than limiting. Furthermore, the dimensions of features of various components that may appear on the drawings are not meant to be limiting, and the size of the components therein can vary from the size that may be portrayed in the figures herein. The scope of the present invention is therefore intended to be limited solely by the scope of the appended claims.

What is claimed is:

1. An internal combustion engine comprising:

a crankcase, and a crankshaft rotatably supported within the crankcase;

at least one cylinder and a cylinder head above the at least one cylinder, the at least one cylinder and the cylinder head together defining at least one combustion chamber;

a piston disposed in the at least one cylinder so as to be capable of reciprocal movement and operatively connected to the crankshaft;

a generator disposed outside the crankcase, the generator being operatively connected to one end of the crankshaft; and a molded ignition housing distinct from the crankcase, the molded ignition housing including a generally cylindrical main body having a length, a first end and a second end, the main body having an opening such that the main body surrounds the generator, the first end connecting the main body to the crankcase; the molded ignition housing being made of a synthetic resin.

2. An internal combustion engine as defined in claim 1, wherein the synthetic resin is an organic thermoplastic.

3. An internal combustion engine as defined in claim 2, wherein the organic thermoplastic is a polyamide based nylon.

4. An internal combustion engine as defined in claim 1, wherein the synthetic resin is reinforced.

5. An internal combustion engine as defined in claim 4, wherein the synthetic resin is reinforced with fibers.

6. An internal combustion engine as defined in claim 1, wherein the molded ignition housing is made of a fiber glass reinforced polyamide 6.6.

7. An internal combustion engine as defined in claim 4, wherein the reinforced synthetic resin has a tensile strength of at least 80 MPa.

8. An internal combustion engine as defined in claim 1, further comprising a recoil starter operatively connected to one end of the crankshaft adjacent the generator.

9. An internal combustion engine as defined in claim 8, further comprising an end plate connected to the second end of the ignition housing, the end plate covering the recoil starter.

10. An internal combustion engine as defined in claim 1, further comprising at least one sensor for determining a position of the piston, the at least one sensor disposed within the ignition housing.

11. An internal combustion engine as defined in claim 10, wherein the at least one sensor is selected from the group consisting of Hall sensors and inductive sensors.

12. An internal combustion engine as defined in claim 1, wherein the crankcase is horizontally split into an upper half and a lower half.

13. An internal combustion engine as defined in claim 1, wherein the second end of the main body includes a rim and the main body includes a recess extending inwardly from the second end at least partially along the length of the main body, the recess having a structural ridge extending on one side of the recess at least partially along the length of the main body.

14. An internal combustion engine as defined in claim 13, comprising a second structural ridge extending on a second side of the recess, along the length of the main body.

15. An internal combustion engine as defined in claim 14, wherein the recess further comprises reinforcement ribs extending along the length of the main body.

16. An internal combustion engine as defined in claim 15, wherein the reinforcement ribs extend from the first side of the main body.

17. An internal combustion engine as defined in claim 13, wherein the main body further comprises cooling vents at least partially disposed around a circumference of the main body.

18. An internal combustion engine as defined in claim 17, wherein the cooling vents are disposed adjacent the rim of the second end of the main body.

19. An internal combustion engine as defined in claim 1, wherein the generally cylindrical main body flares outwardly from the first end to the second end.

20. An internal combustion engine as defined in claim 13, wherein the rim of the second end of the main body extends outwardly from the main body.

21. An internal combustion engine as defined in claim 1, including two cylinders and having a volumetric displacement of at least 400 cc.

22. An internal combustion engine as defined in claim 1, wherein the internal combustion engine operates on a two-stroke principle.

23. A snowmobile comprising:

a frame having a forward end and a rearward end;

a drive track assembly disposed below and supporting the rearward end of the frame;

a front suspension connected to the forward end of the frame;

two skis connected to the front suspension;

a two-stroke engine mounted on the frame and operatively connected to the drive track via a drive train for delivering propulsive power to the drive track;

the two-stroke engine comprising:

a crankcase, and a crankshaft supported within the crankcase for rotation;

at least one cylinder and a cylinder head above the at least one cylinder, the at least one cylinder and the cylinder head together defining at least one combustion chamber;

a piston disposed in the at least one cylinder so as to be capable of reciprocal movement and operatively connected to the crankshaft;

a generator disposed outside the crankcase, the generator being operatively connected to one end of the crankshaft; and a molded ignition housing distinct from the crankcase, the molded ignition housing including a generally cylindrical main body having a length, a first end and a second end, the main body having an opening such that the main body surrounds the generator, the first end connecting the main body to the crankcase; the molded ignition housing being made of a synthetic resin.

* * * * *

UNITED STATES PATENT AND TRADEMARK OFFICE

CERTIFICATE OF CORRECTION

PATENT NO. : 7,409,949 B1
APPLICATION NO. : 11/626310
DATED : August 12, 2008
INVENTOR(S) : Günther Zauner et al.

It is certified that error appears in the above-identified patent and that said Letters Patent is hereby corrected as shown below:

The Title Page, showing an illustrative Figure, should be deleted and substitute therefor the attached Title Page.

The substitution of drawings attached Fig. 1-4.

Signed and Sealed this

Second Day of June, 2009

John Doll

JOHN DOLL
*Acting Director of the United States Patent and Trademark Office*

(12) United States Patent
Zauner et al.

(10) Patent No.: US 7,409,949 B1
(45) Date of Patent: Aug. 12, 2008

(54) IGNITION HOUSING FOR INTERNAL COMBUSTION ENGINE

(75) Inventors: Günther Zauner, Peuerbach (AT); Ernst Mayringer, Ruestorf (AT); Johann Wickenhauser, Offenhausen (AT); Mario Schreiber, Grieskirchen (AT); Thomas Weinzierl, Fraham (AT); Wolfgang Schrenk, Gallneukirchen (AT)

(73) Assignee: BRP-Rotax GmbH & Co. KG, Gunskirchen (AT)

( * ) Notice: Subject to any disclaimer, the term of this patent is extended or adjusted under 35 U.S.C. 154(b) by 0 days.

(21) Appl. No.: 11/626,310

(22) Filed: Jan. 23, 2007

Related U.S. Application Data

(60) Provisional application No. 60/885,976, filed on Jan. 22, 2007.

(51) Int. Cl.
*F02P 7/08* (2006.01)

(52) U.S. Cl. ..... 123/647; 123/143 C; 123/185.3; 180/190

(58) Field of Classification Search ..... 123/143 C, 123/185.2, 185.3, 647; 180/190
See application file for complete search history.

(56) References Cited

U.S. PATENT DOCUMENTS 4,155,340 A * 5/1979 Fernquist et al. ..... 123/647
5,353,758 A * 10/1994 Masuda et al. ..... 123/143 C

* cited by examiner

*Primary Examiner*—T. M Argenbright
(74) *Attorney, Agent, or Firm*—Osler, Hoskin & Harcourt LLP

(57) ABSTRACT

A two-stroke internal combustion engine including a molded ignition housing connected to the crankcase of the engine which protects the electric generator of two-stroke internal combustion engine.

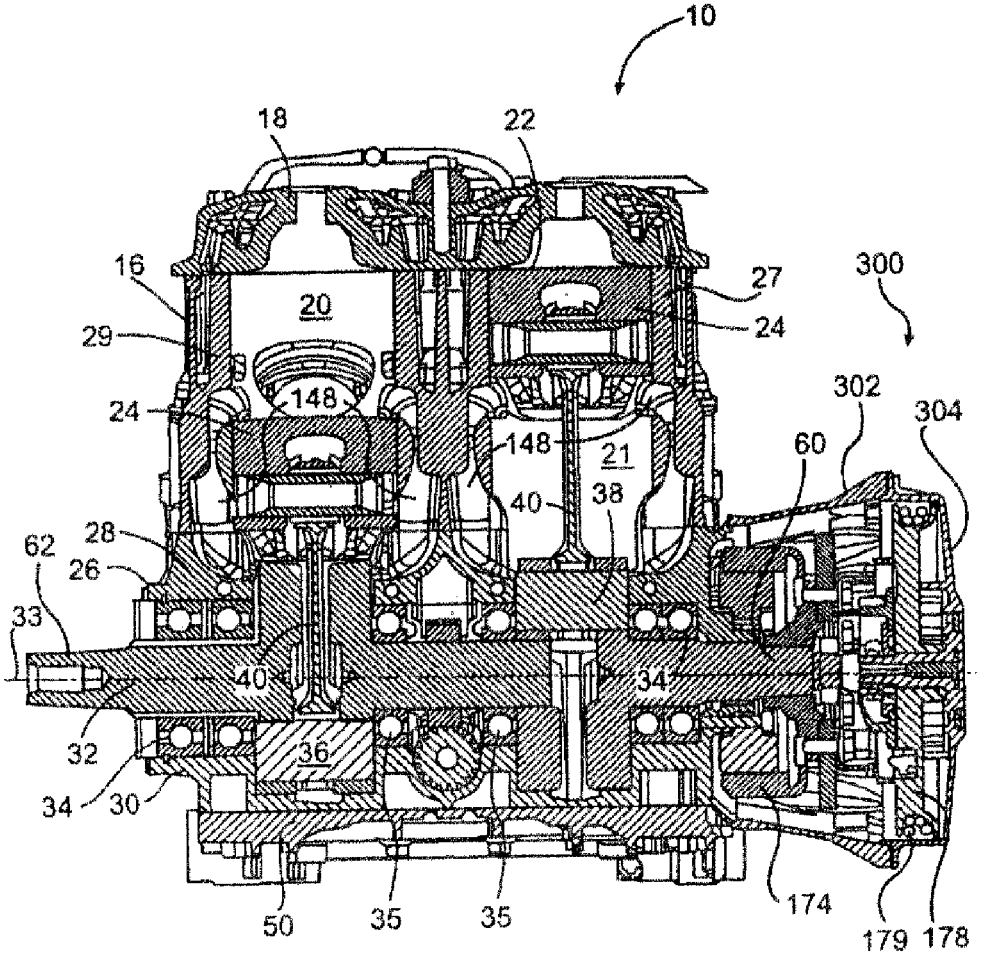

23 Claims, 4 Drawing Sheets